United States Patent [19]

MacLean

[11] 4,362,613

[45] Dec. 7, 1982

[54] HYDROCRACKING PROCESSES HAVING AN ENHANCED EFFICIENCY OF HYDROGEN UTILIZATION

[75] Inventor: Donald L. MacLean, Raleigh, N.C.

[73] Assignee: Monsanto Company, St. Louis, Mo.

[21] Appl. No.: 243,273

[22] Filed: Mar. 13, 1981

[51] Int. Cl.[3] ..... C10G 47/00; C10G 49/22

[52] U.S. Cl. ..... 208/108; 208/102

[58] Field of Search ..... 208/108; 55/16

[56] References Cited

U.S. PATENT DOCUMENTS

| | | | |
|---|---|---|---|
| 3,444,072 | 5/1969 | Lehman | 208/102 |
| 3,445,379 | 5/1969 | Hansen | 208/111 |
| 3,546,099 | 12/1970 | Sutherland | 208/103 X |
| 3,598,722 | 8/1971 | Carson | 208/102 |
| 3,962,070 | 6/1976 | Stotler | 208/10 |
| 4,172,885 | 10/1979 | Perry | 423/359 |
| 4,180,552 | 12/1979 | Graham et al. | 423/360 X |
| 4,180,553 | 12/1979 | Null et al. | 423/360 X |
| 4,230,463 | 10/1980 | Henis et al. | 55/16 |

*Primary Examiner*—Delbert E. Gantz

*Assistant Examiner*—G. E. Schmitkons

*Attorney, Agent, or Firm*—Robert L. Broad

[57] ABSTRACT

A hydrocrackate from a hydrocracking zone operating under hydrocracking conditions is separated into at least one liquid phase and a separated vapor phase wherein the separated vapor phase has a greater concentration of hydrogen than the minimum concentration of hydrogen in the vapor phase in the hydrocracking zone. At least a portion of the separated vapor phase is contacted with the feed side of a polymeric membrane selective to the permeation of hydrogen as compared to the permeation of methane, and the opposite side of the polymeric membrane is maintained at a pressure sufficiently below the pressure at the feed side of the polymeric membrane to permeate hydrogen to the opposite side of the polymeric membrane and to provide a hydrogen permeate having a concentration of hydrogen greater than the concentration of hydrogen in the separated vapor phase and greater than the concentration of hydrogen in the hydrogen feed gas. The hydrogen permeate is compressed and recycled to the hydrocracking zone.

1 Claim, 1 Drawing Figure

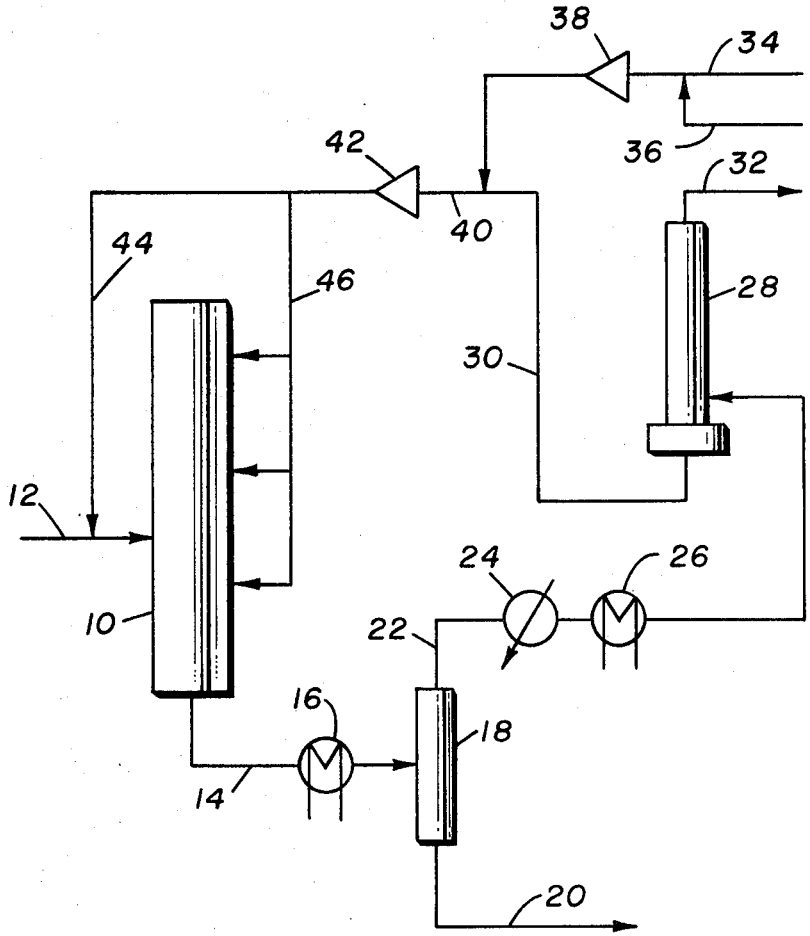
38
34
36
42
32
40
44
46
28
30
12
24
26
10
22
16
18
14
20

HYDROCRACKING PROCESSES HAVING AN ENHANCED EFFICIENCY OF HYDROGEN UTILIZATION

This invention relates to processes for catalytically hydrocracking a hydrocarbonaceous feed, and particularly to catalytic hydrocracking processes in which hydrogen is recovered from the hydrocrackate and is recycled to the hydrocracking zone.

By this invention there are provided processes for hydrocracking hydrocarbonaceous feed stocks which processes exhibit enhanced efficiencies of hydrogen utilization. In accordance with the processes of this invention, the enhanced efficiencies of hydrogen utilization can be achieved with little additional energy consumption over similar hydrocracking processes which do not provide the enhanced efficiencies of hydrogen utilization. Moreover, the enhanced efficiencies of hydrogen utilization provided by the hydrocracking processes of this invention can be achieved without undue deleterious effects on the maintenance or operation of equipment for effecting the hydrocracking. Furthermore, existing equipment for effecting hydrocracking can readily be modified to utilize processes in accordance with this invention and, if desired, the throughput of a hydrocarbonaceous feed stock in a hydrocracker may be increased and the yield of $C_5+$ hydrocarbons may also be increased. Additionally, the processes of this invention may reduce the amount of hydrogen which needs to be produced by, say, a hydrogen plant to ensure that the hydrocracking zone has sufficient hydrogen of adequate purity to enable the hydrocracking to proceed in an advantageous manner.

Petroleum crude feed stocks contain a broad range of molecular weight components. Frequently, the heavier fractions of the petroleum crude feed stocks are cracked, i.e., broken down into smaller molecules, in order to provide desirable hydrocarbonaceous products, e.g., for direct consumer use or as a feed to other refinery operations. In recent years a lack of availability of high grade petroleum crude feed stocks has existed, and refiners are therefore faced with using lower grade petroleum crude feed stocks which, for instance, have greater and greater portions of heavy fractions. Accordingly, refiners must effectively use cracking processes in order to use these available petroleum crude feed stocks to make highly sought petroleum products. One of the advantageous cracking processes in hydrocracking in which free hydrogen, i.e., atomic or molecular hydrogen (hereinafter referred to as "hydrogen"), is present during a catalytically-promoted cracking process. The hydrogen serves several important functions. The hydrogen can, under certain conditions, react with polycyclic aromatic components which are generally relatively inert to cracking, to convert the polycyclic aromatics to compounds which can be cracked more readily. The hydrogen can reduce the production of unsaturated hydrocarbons. Moreover, the hydrogen can reduce the formation of tar and coke during the hydrocracking process. Hence, the hydrogen can minimize the production of less saleable by-products as well as minimize the rate of deactivation of catalyst used to effect the hydrocracking. For example, it has been estimated that a one percent increase in hydrogen purity in a hydrocracker may, under certain circumstances, increase the cycle length between hydrocracking catalyst regeneration by about one percent. Also, an increase in hydrogen purity can increase the $C_5+$ yield from the hydrocracker.

In order to achieve these results, a relatively high hydrogen partial pressure must be maintained throughout the hydrocracking reaction zone. Thus, hydrocracking can be an extremely large consumer of hydrogen within a refinery operation, and the hydrogen must be supplied by a source external from the hydrocracker. In many refineries, at least a portion of the hydrogen is provided by the production of hydrogen from hydrocarbon in a hydrogen plant. Frequently, a significant portion of the hydrogen or hydrocracking is provided by hydrogen-producing operations within the refinery, e.g., catalytic reforming. However, as lower grade petroleum crude feed stocks may need to be used by the refinery not only will a greater portion of the feed stock need to be subjected to hydrocracking to provide the sought petroleum products (thereby requiring an increased hydrocracking throughput and demand for hydrogen), but also the quantity and purity of hydrogen produced during catalytic reforming will usually be decreased. Consequently, an increase in hydrogen production from the hydrogen plant may be necessary. The hydrogen plant, however, diverts valuable hydrocarbons from otherwise more useful forms into the production of hydrogen.

In order to reduce the demand for hydrogen from a hydrogen plant it is generally desired to not use the hydrogen on a once through basis, but rather, to recycle hydrogen to the hydrocracking zone. Accordingly, in most instances, a portion of the hydrogen is recovered from the effluent (hydrocrackate) from the hydrocracking zone by a gas-liquid separation with the separated vapor phase being recycled to the hydrocracking zone. Under certain conditions the concentration of hydrogen in the separated vapor phase may be as high as 80 or more volume percent and thus be directly useful for recycling to the hydrocracking zone due to its high hydrogen concentration. Although recycling hydrogen from the hydrocrackate to the hydrocracking zone may decrease the need for fresh hydrogen feed, a still significant demand may be placed on the hydrogen plant to provide sufficient fresh hydrogen for the hydrocracking and to ensure that suitable hydrogen partial pressures are maintained in the hydrocracking zone.

Although recycling hydrogen from the hydrocrackate to the hydrocracking zone has proven to be beneficial, further efficiencies of hydrogen utilization are still sought. It is desired that the enhanced efficiencies of hydrogen utilization be provided by means which are compatible with the hydrocracking process and do not adversely affect the hydrocracker throughput or the overall economics, including capital expenditures and operating expenditures (including maintenance and energy consumption) of the hydrocracking process.

Membranes have been proposed for gas separations including the separation of hydrogen from other gases. Henri suggests only that membranes might be useful in processing gases from hydrocracking operations but does not disclose any of the specifics which are necessary in order to provide an operable, efficient hydrocracking process.

In accordance with this invention, hydrocracking processes are provided which can exhibit an enhanced utilization of hydrogen. In the processes of this invention polymeric membranes are employed to recover hydrogen as a hydrogen permeate from at least a portion of a hydrogen-rich vapor phase separated by gas-liquid separation from the hydrocracker (hereafter "separated vapor phase"). The separated vapor phase is substantially in equilibrium with the liquid phase from which it is separated and is at a sufficiently low temperature and a sufficiently high pressure that the concentration of hydrogen in the separated vapor phase is greater than the minimum hydrogen concentration in the vapor phase in the hydrocracking zone (hydrocracking vapor phase). At least a portion of the separated vapor phase contacts the feed side of the polymeric membrane, and the hydrogen permeate is obtained at the opposite side, i.e., permeate exit side, of the membrane. The hydrogen permeate has a greater concentration of hydrogen than the concentration of hydrogen in the separated vapor phase and a greater hydrogen purity than the hydrogen feed gas to the hydrocracking zone. The hydrogen permeate having the high hydrogen concentration is compressed to a sufficient pressure for passage to the hydrocracking zone and is passed to the hydrocracking zone as a portion of the total hydrogen feed gas to the hydrocracking zone.

The processes of this invention have been found to provide many advantages. For instances, the hydrogen concentration of the hydrogen permeate is generally very high due to the high hydrogen concentration of the separated vapor phase fed to the membrane. Hence, the highly-pure hydrogen permeate can off-set the demand for hydrogen from the hydrogen plant to provide a hydrogen feed gas having an adequate concentration of hydrogen to maintain a desired hydrogen partial pressure in the hydrocracking zone. Thus, the combination of the hydrogen permeate with less pure hydrogen-containing streams from, say, catalytic reformers, hydrotreaters, etc., would provide a combined gas having a concentration of hydrogen greater than the less pure hydrogen-containing streams. Therefore, a lesser amount of hydrogen from a hydrogen plant per unit volume of the less pure hydrogen-containing stream need be employed. Moreover, since the separated vapor phase fed to the membrane has a high hydrogen partial pressure, an advantageous driving force for the permeation of hydrogen through the membrane can be achieved. With advantageous driving forces for the permeation of hydrogen, desirable rates of hydrogen permeation can be achieved such that, say, a relatively small membrane area need be employed (thereby reducing capital costs) and/or desirably high concentrations of hydrogen in the hydrogen permeate can readily be obtained and/or the hydrogen permeate can be at a desirably high pressure to minimize recompression costs for recycling the hydrogen permeate to the hydrocracking zone. Furthermore, the increased concentration of hydrogen provided by the hydrogen permeate of this invention can also be utilized to increase the hydrogen partial pressure in the hydrocracking zone and/or increase hydrocarbonaceous feed throughput in the hydrocracking zone. In fact, in some instances, the rate of hydrogen supplied to the hydrocracking zone in the total hydrogen feed gas may be decreased without decreasing the hydrocarbonaceous feed throughput in the hydrocracking zone. Also, higher hydrogen concentrations in the hydrogen feed gas (at a given hydrocarbonaceous feed throughput) can enable the use of lower pressures in the hydrocracking zone. Thus savings in compression expenses to operate the hydrocracking zone may be realized. Hence, enhanced efficiencies of hydrogen utilization can be readily achieved by the processes of this invention without unduly deleteriously affecting the hydrocracking operation.

The advantages which may be provided by aspects of the processes of this invention may be related not only to the enhanced utilization of hydrogen but also to the removal of potentially deleterious gases in the separated vapor phase. For example, the hydrocarbonaceous feed may contain nitrogen-bearing components which, when cracked, yield free nitrogen. Free nitrogen and hydrogen can react under the hydrocracking conditions to produce ammonia which tends to deactivate many hydrocracking catalysts. With hydrocarbonaceous feeds containing nitrogen-bearing components, the hydrocrackate will contain nitrogen, and a portion of that nitrogen will be separated from the liquid phase and thus be contained in the separated vapor phase. If this nitrogen-containing separated vapor phase were directly recycled to the hydrocracking zone, a build-up of nitrogen may result which may cause an increase in the production of ammonia and a more rapid deactivation of the catalyst. In an aspect of this invention, the separated vapor phase may be passed to a membrane which is selective to the permeation of hydrogen as compared to the permeation of nitrogen such that the hydrogen permeate contains very little nitrogen. The recycling of the hydrogen permeate to the hydrocracking zone would not, therefore, result in an undesirable build-up of nitrogen in the hydrocracking zone.

In the processes of this invention, a hydrocarbonaceous feed is cracked in a hydrocracking zone in the presence of hydrogen and hydrocracking catalyst under hydrocracking conditions. Hydrocarbonaceous feeds suitable for hydrocracking include petroleum- or coal-based hydrocarbon stocks. Usually the hydrocarbonaceous feed to a hydrocracking operation results from a fractionation of a crude stock and comprises that fraction boiling above about 200° C. and may include residual stocks having at least about 10 percent by volume boiling above 550° C. Frequently, the hydrocarbonaceous feed to the hydrocracking zone is treated with hydrogen to accomplish desulfurization, demetalization, denitrogenation and the like in order to remove components which may adversely affect the hydrocracking catalyst or may be undesirable in the hydrocrackate.

The hydrocarbonaceous feed is usually below the temperature of the hydrocracking zone and therefore may often be heated to about the temperature of the hydrocracking zone prior to being introduced into the hydrocracking zone. The temperature of the hydrocarbonaceous feed prior to being introduced into the hydrocracking zone is preferably below that which promotes thermocracking, at least prior to the introduction of the hydrocarbonaceous feed into the hydrocracking zone, since thermocracking may often produce cracked products which are less desirable than those obtained through hydrocracking. The temperature of the hydrocracking zone is frequently at least about 250° to 270° C. and may range up to about 700° or 750° C. In most instances, the temperature of the hydrocracking zone is about 300° or 350° C. to about 450°. Usually the total pressure in the hydrocracking zone is at least about 45, say, about 50 to about 200 or 250 atmospheres absolute.

Generally, the hydrocarbonaceous feed is admixed with at least a portion of the hydrogen feed gas prior to introducing the hydrocarbonaceous feed into the hydrocracking zone. The hydrogen feed gas is desirably provided in an amount sufficient to effect the hydrocracking reactions and to provide a sufficient hydrogen partial pressure throughout the hydrocracking reaction zone to avoid unduly rapid coking and deactivation of the hydrocracking catalyst. Usually in order to maintain the desired hydrogen partial pressure, the amount of hydrogen provided to the hydrocracking zone is substantially greater than the amount of hydrogen consumed in the hydrocracking reactions. The amount of hydrogen provided to the hydrocracking zone is usually about 0.05 to 10, preferably, about 0.1 to 5, $Nm^3$, normal cubic meters ($Nm^3$) per liter of hydrocarbonaceous feed. The hydrogen feed gas frequently contains at least about 75, preferably at least about 80, volume percent of hydrogen. Generally, with lower pressures in the hydrocracking zone, higher hydrogen concentrations in the hydrogen feed gas are desired. The hydrogen feed gas to the hydrocracking zone is preferably heated to approximately the temperature of the hydrocracking zone prior to being introduced into the hydrocracking zone. Often, in order to ensure a good dispersion of the hydrogen with the hydrocarbonaceous feed, the hydrogen feed gas and hydrocarbonaceous feed are admixed prior to being introduced into the hydrocracking zone.

The hydrocarbonaceous feed generally contacts the hydrocracking catalyst at a liquid hourly space velocity (the volume of liquid hydrocarbonaceous feed at 20° C. per volume of catalyst within the reaction zone) of about 0.1 to 10, e.g., about 0.5 to 5, reciprocal hours. Any suitable hydrocracking catalyst may be utilized, and, generally, hydrocracking catalysts comprise one or more metallic components selected from Groups VI-A and VIII of the periodic table of elements. Frequently the catalyst comprises at least one metal, metal oxide, or metal salt of chromium, molybdenum, tungsten, iron, cobalt, nickel, ruthenium, rhodium, palladium, osmium, iridium, and platinum on a support. The support for the metallic components for hydrocracking catalysts is usually an inorganic oxide, and may preferably be of an acidic nature. Included within suitable inorganic oxides are alumina, silica, crystalline alumina silicates, and the like. The catalyst may, for instance, be in a fixed bed in the hydrocracking zone or moving bed or fluidized bed operations may be employed. Also, the catalyst may be in a suspension and passed through the reaction zone as a slurry.

The hydrocracking zone usually contains liquid phase and hydrocracking vapor phase constituents. Preferably, the minimum concentration of hydrogen in the hydrocracking vapor phase is at least about 65 volume percent. The minimum concentration of hydrogen in the hydrocracking vapor phase is approximated by the concentration of hydrogen in the vapor phase of the hydrocrackate at the conditions of the hydrocracking zone. In many instances, the minimum concentration of hydrogen in the hydrocracking vapor phase is about 65 to 85, say, 70 to 80, volume percent. The hydrocrackage exiting the hydrocracking zone contains substantial amounts of hydrogen in a vapor phase as well as dissolved in the liquid phase of the hydrocrackate.

The hydrocrackate is passed to a gas-liquid separator in order to recover a substantial portion of the hydrogen. In accordance with the processes of this invention, the gas-liquid separation is conducted to provide a separated vapor phase substantially in equilibrium with the liquid phase from which it is separated, the separated vapor phase being at a sufficiently low temperature and at a sufficiently high pressure that the separated vapor phase comprises a greater concentration of hydrogen than the minimum concentration of hydrogen in the hydrocracking vapor phase. Most frequently, the temperature of the gas-liquid separation is below about 70° C., e.g., 20° to 70° C., say, about 20° to 50° or 55° C. Usually, the pressure of the separated vapor phase is at least about 0.5 times the pressure in the hydrocracking zone. More frequently, the pressure of the separated vapor phase is up to about the pressure in the hydrocracking zone, e.g., about 0.9 to 1 times the pressure in the hydrocracking zone. The separated vapor phase may be at a pressure greater than that of the hydrocracking zone; however, the expense of compression to achieve such pressures is generally not economically justifiable. Particularly in instances in which a portion of the separated vapor phase is recycled to the hydrocracking zone without contacting the membrane, pressure losses to the vapor phase are preferably minimized to reduce recompression requirements. Often, the separated vapor phase has a hydrogen concentration of at least about 70, say, at least about 75, e.g., 75 to 85 or 90, volume percent.

The gas-liquid separation may be conducted in any suitable manner. For instance, the hydrocrackate may be cooled to, say, below about 70° C. and then the vapor and liquid phases separated, or the separation may proceed in a series of steps. For example, the hydrocrackate, at an elevated temperature, may be separated into a first liquid phase and a first vapor phase. The first vapor phase is then cooled to below about 70° C. thereby resulting in the formation of a condensed liquid, and these vapor and liquid phases are then separated. The latter gas-liquid separation procedure may be advantageous in certain instances to minimize heat exchanger requirements since a smaller volume of fluid need be cooled to temperatures below about 70° C. Any suitable gas-liquid separation apparatus may find use in the process such as knock-out pots (gravity separators), impingement separators, cyclonic separators, and the like.

At least a portion of the separated vapor phase from the gas-liquid separator is contacted with the polymeric membrane to obtain a hydrogen permeate. For instance, the separated vapor phase may be split into two streams, one of which is directly recycled to the hydrocracking zone and the other of which is contacted with the polymeric membrane. Alternatively, all of the separated vapor phase may be passed to the polymeric membrane. When the separated vapor phase is split into two streams, the portion of the separated vapor phase which is contacted with the polymeric membrane is preferably at least about 5, e.g., at least about 10, say, about 10 to 95, percent of the total separated vapor phase. The portion of the separated vapor phase which is contacted with the polymeric membrane may be selected in view of various factors such as the desired purity of the hydrogen recycled to the hydrocracking zone, the selectivity of the separation of the polymeric membrane, the membrane surface area required to effect the separation, the expense of recompression of the hydrogen permeate, and the like. The processes of this invention may be particularly attractive with respect to hydrocracking processes of the general type in which the separated vapor phase is recycled to the hydrocracking zone and a portion of the separated vapor phase is expelled (i.e., purged on a continuous or intermittent basis) to prevent undue build-up of undesirable components in the hydrocracking vapor phase (thereby reducing the hydrogen partial pressure). The processes of this invention can substantially reduce the loss of hydrogen since the portion of the separated vapor phase which would otherwise be expelled can be contacted with the membranes, and thus only the gases not permeating the polymeric membrane, i.e., hydrogen-depleted gases, would be expelled from the system.

In many instances it is desired to slightly increase the temperature of the portion of the separated vapor phase passing to the feed side of the polymeric membrane (i.e., feed vapor phase). This increase in temperature may in some instances be sufficient to prevent undue condensation of any components in the feed vapor phase on the polymeric membrane during the permeation operation. Frequently, the feed vapor phase is heated to increase the temperature of the feed vapor phase by at least about 5° or 10°, e.g., about 10° to 60° C. Also, the feed vapor phase may be processed in another gas-liquid separator, e.g., knock-out pot, cyclone separator, or impingement separator to remove entrained liquids. Most desirably, the entrained liquids are removed prior to any heating of the feed vapor phase to be contacted with the polymeric membrane. The temperature of feed vapor phase is preferably below that temperature which may adversely affect the polymeric membrane. Usually, the temperature of the feed vapor phase contacting the polymeric membrane is less than about 125° C., e.g., less than about 65° C., and is often about 10° to 60° C., preferably at least about 20° or 25° to 55° C.

In order to effect the permeation of hydrogen through the polymeric membrane, a driving force for the permeation must exist. According to current theory, this driving force is a differential in fugacities of hydrogen across the polymeric membrane. Since fugacities for ideal gases are approximated by partial pressures, conveniently the driving force is referred to in terms of partial pressure differentials. Since partial pressures are related to the concentration of a moiety in a gas and the total pressure of the gas, these parameters can be varied jointly or separately to provide suitable partial pressure differentials across the membrane in order to provide desirable permeation fluxes. Since the feed vapor phase already contains a high concentration of hydrogen and is at a high pressure, the feed vapor phase has an advantageously high partial pressure of hydrogen to enable desirable driving forces for hydrogen permeation to be achieved. Moreover, large driving forces for the permeation of hydrogen can often be provided without the need to maintain the permeate exit side of the membrane at such low total pressures that an undue amount of compression is required to increase the pressure of the hydrogen permeate for reintroduction into the hydrocracking zone. The large driving forces which are obtainable in the processes of this invention can, for instance, enable advantageous rates of permeation of hydrogen and thus excessive membrane surface area need not be required to obtain a desired amount of hydrogen permeate. Moreover, the large driving forces can also enhance the hydrogen purity in the hydrogen permeate with a feed vapor phase of a given hydrogen concentration.

In many instances the permeate exit side of the polymeric membrane is often at least about 7 or 15 atmospheres absolute, and may be as high as 40 or more atmospheres absolute, in order to minimize recompression costs for reintroducing the permeated hydrogen into the hydrocracking zone while still providing desirable recoveries of hydrogen. Frequently, the total pressure on the permeate exit side of the polymeric membrane is at least about 20 atmospheres below the pressure on the feed side of the polymeric membrane. In many instances, this total pressure differential is at least about 35 or 40 atmospheres absolute and, depending upon the strength of the membrane, this pressure differential may be up to about 100 or 150 atmospheres.

In general, the recovery of hydrogen from the feed vapor phase and the purity of hydrogen in the hydrogen permeate are interrelated. For instance, the purity of the hydrogen in the hydroge permeate decreases with increased recovery of hydrogen from the feed vapor phase. The percentage of the hydrogen in the feed vapor phase which permeates the polymeric membrane will depend on the amount of hydrogen desired in the hydrogen permeate and the required purity of that hydrogen. Usually, the percentage of hydrogen permeating is at least about 50, say, at least about 70, often about 70 to 95, percent of the hydrogen in the feed vapor phase.

The hydrogen permeate from the polymeric membrane has a hydrogen purity greater than that of the feed vapor phase. The increase in hydrogen purity which is achieved will depend, in part, upon the hydrogen concentration of the feed vapor phase, the selectivity of the polymeric membrane, the permeability of the polymeric membrane to hydrogen, the effective membrane surface area (i.e., that membrane surface area available for effecting separations), and the driving force for the permeation of hydrogen. One method for expressing the increase in hydrogen purity is in terms of the contaminant reduction ratio which is defined as the quantity of 100 minus the hydrogen purity percentage of the hydrogen permeate ($H_2\%_{PS}$) divided by the quantity of 100 minus the hydrogen purity of the feed vapor phase ($H_2\%_{FG}$).

$$\text{Contaminant reduction ratio} = (100 - H_2\%_{PS})/(100 - H_2\%_{FG})$$

Frequently the contaminant reduction ratio is less than about 0.7, say, about 0.01 to 0.5. The hydrogen permeate often contains at least about 90, e.g., about 90 to 99, volume percent hydrogen.

The hydrogen permeate which is recovered from the permeate exit side of the polymeric membrane can be removed and, preferably, without additianal recompression be admixed with a hydrogen-containing stream providing another portion of the hydrogen feed gas to the hydrocracking zone (make-up hydrogen stream). In order to introduce the hydrogen permeate to the make-up hydrogen stream, the make-up hydrogen stream should be at a slightly lower total pressure, e.g., than the total pressure of the hydrogen permeate. The mixture of the hydrogen permeate and make-up hydrogen stream is preferably at a total pressure of at least about 5 or 20 atmospheres absolute and is compressed to about the pressure in the hydrocracking zone. This compression may occur in several stages. For instance, if a portion of the separated vapor phase is recycled directly to the hydrocracking zone without contacting the membrane, a recycle compressor is required to reintroduce this gas into the hydrocracking zone. The admixed make-up hydrogen stream and hydrogen permeate may thus be compressed to a sufficient pressure for introduction into the recycle stream passing to the suction of the recycle compressor.

The non-permeate stream from the membrane may be used for any suitable purpose. For instance, hydrocarbon products may be recovered from the non-permeate stream, the non-permeate stream may be used as a feed to a petroleum or petrochemical conversion operation or the non-permeate stream may be used for fuel. Since the non-permeate stream can be at essentially the same pressure as the feed vapor phase contacting the polymeric membrane, significant amounts of energy can be recovered from it by, for instance, the use of a turbine.

Suitable polymeric membranes for use in the processes of this invention need not exhibit extremely high selectivities of separation in order to recover a hydrogen permeate during an adequate purity for use in hydrocracking. Generally, the selectivity of separation of a membrane (separation factor) is described in terms of the ratio of the permeability of the fast permeating gas (e.g., hydrogen) to the permeability of the slow permeating gas (e.g., methane) wherein the permeability of the gas through the membrane can be defined as the volume in cubic centimeters of gas at standard temperature and pressure, which passes through a membrane per square centimeter of surface area, per second, for a partial pressure differential of 1 centimeter of mercury across the membrane. Often, the separation factor of suitable polymeric membranes is at least about 7 or 10 for the separation of hydrogen over methane. In many instances, the separation factor for hydrogen over methane is at least about 20, say, at least about 25. Separation factors for hydrogen over methane of 100 or greater may be provided by certain polymeric membranes; however, polymers which provide such extremely high separation factors often exhibit low permeabilities to hydrogen. Therefore, the polymer for a membrane may be selected on its ability to quickly permeate hydrogen rather than on its selectivity of separation. Clearly, the higher the permeability of hydrogen through a polymeric membrane, the less available membrane surface area required under given conditions to permeate a desired amount of hydrogen through the polymeric membrane. Particularly desirable polymeric membranes exhibit hydrogen permeabilities of at least about $1\times10^{-6}$, preferably at least about $20\times10^{-6}$, cubic centimeters of hydrogen per square centimeter of membrane surface area per second at a partial pressure differential of 2 centimeter of mercury across the membrane at 25° C. When the feed vapor phase contains unduly deleterious amounts of nitrogen it is preferred that the polymeric membrane also exhibit a separation factor for hydrogen over nitrogen of at least about 10 or 20.

Polymeric membranes include membranes of organic polymer or organic polymer mixed with inorganics such as fillers, reinforcements, etc. Polymers which may be suitable for the polymeric membranes and which may exhibit suitable selectivities for the permeation of hydrogen as compared to the permeation of each of methane and nitrogen, can be substituted or unsubstituted polymers and may be selected from polysulfones; poly(styrenes), including styrene-containing copolymers such as acrylonitrile-styrene copolymers, styrene-butadiene copolymers and styrene-vinylbenzylhalide copolymers; polycarbonates; cellulosic polymers, such as cellulose acetate, cellulose propionate, ethyl cellulose, methyl cellulose, nitrocellulose, etc.; polyamides and polyimides, including aryl polyamides and aryl polyimides; polyethers, poly(arylene oxides) such as poly(phenylene oxide) and poly(xylylene oxide); poly(esteramide-diisocyanate); polyurethanes; polyesters (including polyarylates), such as poly(ethylene terephthalate), poly(alkyl methacrylates, poly(alkyl acrylates), poly(phenylene terephthalate), etc.; polysulfides; poly(siloxanes); polymers from monomers having alpha-olefinic unsaturation other than mentioned above such as poly(ethylene), poly(propylene), poly(butene-1), poly(4-methyl pentene-1), polyvinyls, e.g., poly(vinyl chloride), poly(vinyl fluoride), poly(vinylidene chloride), poly(vinylidene fluoride), poly(vinyl alcohol), poly(vinyl esters) such as poly(vinyl acetate) and poly(vinyl propionate), poly(vinyl pyridines), poly(vinyl pyrrolidones), poly(vinyl ethers), poly(vinyl ketones), poly(vinyl aldehydes) such as poly(vinyl formal) and poly(vinyl butyral), poly(vinyl amines), poly(vinyl phosphates), and poly(vinyl sulfates); polyacetal; polyallyls; poly(benzobenzimidazole), polyhydrazides; polyoxadiazoles; polytriazoles; poly(benzimidazole); polycarbodiimides; polyphosphazinesl; etc., and interpolymers, including block interpolymers containing repeating units from the above, and grafts and blends containing any of the foregoing. Typical substituents providing substituted polymers include halogens such as fluorine, chlorine and bromine; hydroxyl groups; lower alkyl groups; lower alkoxy groups; monocyclic aryl; lower acyl groups and the like.

Generally, aromatic-containing polymers are preferred for the polymeric membranes due to strength and due to the relatively high chemical resistance of these membranes to moieties in the feed vapor phase especially lower paraffins which usually are the predominant hydrocarbons in the feed vapor phase. Particularly preferred polymers include aromatic-containing polysulfones, polycarbonates, poly(arylene oxides), polyamides and polyimides. Some useful aromatic-containing polymers have both aliphatic and aromatic carbons, such as polymers containing bisphenol A-derived units within their polymeric backbones.

Since the rate of permeation through a polymeric membrane is affected by the thickness of the membrane through which a permeating moiety must pass, the membrane is preferably as thin as possible yet sufficiently thick to provide adequate strength to the membrane to withstand the separation conditions. The membrane may be isotropic, i.e., have substantially the same density throughout, or may be anisotropic, i.e., have at least one zone of greater density than at least one other zone of the membrane. Anisotropic membranes are frequently advantageous since a moiety need only pass through a portion of the overall structural thickness of the polymeric membrane. The polymeric membrane may be chemically homogeneous, i.e., constructed of the same material, or may be a composite membrane. Suitable composite membranes may comprise a thin layer which effects the separation on a porous physical support which provides the necessary strength to the membrane to withstand membrane separation conditions but offers little resistance to gas flow. Other suitable composite membranes are the multicomponent membranes such as disclosed by Henis, et al., in U.S. Pat. No. 4,230,463, herein incorporated by reference. These membranes comprise a porous separation membrane which substantially effects the separation and a coating material in occluding contact with the porous separation membrane. These multicomponent membranes are particularly attractive for gas separations in that good selectivity of separation and high flux through the membrane can be obtained. The materials for the coating of the multicomponent membranes such as disclosed by Henis, et al., may be natural or synthetic substances, and are often polymers, and advantageously exhibit the appropriate properties to provide occluding contact with the porous separation membrane.

A permeator containing the polymeric membrane may be of any suitable design for gas separations, e.g., plate and frame, or having spiral wound film membranes, tubular membranes, hollow fiber membranes, or the like. Preferably, the permeator comprises hollow fiber membranes due to the high membrane surface area per unit volume which can be obtained. When the membranes are in tubular or hollow fiber form, a plurality of the membranes can be arranged in parallel in a bundle and the feed vapor phase can be contacted with either the outside (shell side) or the inside (bore side) of the membranes. Preferably, the feed vapor phase is contacted with the shell side of the hollow filament membranes since passage of the feed vapor phase through the bore side of the membranes may involve substantially greater pressure losses to the feed vapor phase, which pressure losses can detract from the driving force for permeation and may unduly reduce the pressure of the non-permeate stream. Since the concentration of hydrogen on the feed side of the membrane is continually diminishing as hydrogen permeates to the permeate exit side of the membrane, the hydrogen partial pressure differential across the membrane is continually changing. Therefore, flow patterns in the permeator can be utilized to provide desirable recoveries of hydrogen from the feed vapor phase. For instance, the flows of the feed vapor phase and the hydrogen permeate can be concurrent or countercurrent. With bundles of hollow fiber or tubular membranes, the shell side feed can be radial, i.e., the feed vapor phase transversely flows past the membranes either to the inside or, usually, the outside of the bundle, or the flow can be axial, i.e., the feed vapor phase disperses within the bundle and generally flows in the direction in which the hollow fibers or tubular membranes are longitudinally oriented.

Hollow fibers are an often preferred configuration for polymeric membranes for use in processes for recovering hydrogen from petroleum conversion operations. Generally, the hollow fibers have an essentially cylindrical configuration with an outside diameter of about 50 to 1000, preferably, about 100 to 800, microns, and a concentric bore wherein the ratio of the wall thickness to outside diameter is about 0.1 to 0.45, say, about 0.15 to 0.35.

An understanding of the invention may be facilitated by reference to the attached drawing which is a schematic representation of one type hydrocracking system utilizing processes of this invention. The schematic diagram and its description are not intended to be a limitation of the scope of this invention. It is to be understood that some valves, pumps, compressors, separators, reboilers and the like have been deleted from the schematic diagram for purposes of clarity and understanding the processes of the invention.

A hydrocracker is generally designated by the numeral 10 which receives a hydrocarbonaceous feed via a line 12. The hydrocrackate exits hydrocracker 10 via a line 14, is cooled in a heat exchanger 16, and passes to a separator vessel 18 from which a vapor phase product and a liquid phase product are obtained. The liquid phase product exits the separator vessel 18 via a line 20 and may be passed to, e.g., a low pressure separator for additional recovery of hydrogen and to a fractionation column to segragate the desired products. The vapor phase product exits the first separator vessel 18 via a line 22 and passes to an entrained liquid separator 24. The entrained liquid separator 24 may conveniently be a knock-out pot provided with a fibrous demister. The vapor phase then passes to a heat exchanger 26 wherein the gas is suitably heated for introduction into a permeator 28, and then passes to the permeator 28.

As depicted the permeator 28 is a single-ended permeator having the vapor phase contact the exterior of the polymeric membranes contained therein. FIG. 5 of U.S. Pat. No. 4,171,885, herein incorporated by reference, schematically depicts a single-ended permeator. The polymeric membranes are conveniently in the form of hollow fibers. A hydrogen permeate is withdrawn from the interior of the hollow fibers and passes through a line 30 for a combination with a make-up hydrogen stream passing to the hydrocracker. The nonpermeating gas (i.e., the hydrogen depleted gas) is removed from the permeator 28 via a line 32.

A make-up hydrogen stream from a hydrogen providing source from within the refinery (which may form a hydrotreater) is passed via a line 34 to the hydrocracker system. As depicted the make-up hydrogen stream in the line 34 is combined with relatively pure hydrogen from a hydrogen plant (not shown) via a line 36. The pressures of these gases are usually relatively low, e.g., about 3 to 10 atmospheres absolute and are compressed in a compressor 38 to a pressure suitable for combination with the hydrogen permeate in the line 30. The compressed gases exit the compressor 38, are admixed with hydrogen permeate from the line 30 in a line 40 and then are passed to a compressor 42 which increases the pressure of the gases to a level at which the gases can be introduced into the hydrocracker. Lines 44 and 46 conduct the gases from the compressor 42 to the hydrocracker 10.

In order to facilitate an understanding of the invention, the following examples are provided. In order that the important parameters influenced by the invention can readily be discerned, the examples do not recite the myriad of details of the hydrocracking process which are well known to those skilled in the hydrocracking art. All parts and percentages are by weight unless otherwise stated.

A hydrocracking process prior to modification by this invention can be simplified to comprise a hydrocracking vessel and a high pressure-gas-liquid separator. The hydrocarbonaceous feed and hydrogen feed gas are preheated and combined for passage to the hydrocracking vessel, and the hydrocrackate from the hydrocracking vessel is cooled and passed to a high pressure separator (at a pressure of about 150 atmospheres absolute and a temperature of about 46° C.) with the separated vapor phase being compressed and recycled to the hydrocracking vessel. When modified in accordance with this invention as is depicted in the drawing, the separated vapor phase is passed to a knock-out pot with a fibrous demister, heated to 55° C., split into 32 substantially equal streams with each stream passing to a single-ended permeator containing hollow fiber membranes providing about 375 square meters of effective membrane surface area. The hollow fiber membranes are polysiloxane-coated anisotropic polysulfone hollow fibers such as disclosed in Example 1 of U.S. patent application Ser. No. 117,851, filed Feb. 20, 1980, herein incorporated by reference. The hollow fiber membranes exhibit a hydrogen permeability of about $8\times10^{-6}$ cubic centimeters of hydrogen (STP) per square centimeter of membrane surface area per second per centimeter of mercury partial pressure differential. The separation factor for hydrogen over methane is about 80.

The hydrocarbonaceous feed stock comprises 120,000 kilograms per hour of a catalytically-cracked product which contains aromatics and olefins, and 50,000 kilograms per hour of a recycled higher boiling liquid phase obtained by distilling the hydrocrackate. The make-up hydrogen is obtained from a hydrotreater off gas containing about 73 volume percent hydrogen and substantially pure hydrogen from a hydrogen plant. The hydrocracking vessel is operated at a pressure of about 150 atmospheres absolute. The high pressure separator is at a pressure of about 142 atmospheres absolute and a temperature of about 46° C. When the separated vapor phase is passed to the permeators, the permeate exit side of the permeators is at a pressure of about 70 atmospheres absolute.

Three simulations were conducted and the relevant information is provided in Table I. Simulation A is a comparative simulation illustrating the unmodified operation of the hydrocracker system. In simulations B and C, the separated vapor phase is passed to the permeators, and the total amount of hydrogen passed to the hydrocracker vessel is maintained constant with respect to the comparative simulation. In simulation B no hydrogen from the hydrogen plant is used as make-up, whereas in simulation C the amount of hydrogen from the hydrogen plant is the same as that in the comparative simulation.

TABLE I

| | A (Comparative) | B | C |
|---|---|---|---|
| Hydrocracker: | | | |
| Temperature, °C. | 394 | 393 | 390 |
| Hydrocrackate: | | | |
| $C_5^+$, kg/hr | 155,000 | 155,500 | 156,000 |
| $H_2$, kg/hr | 7,000 | | |
| Vapor phase minimum $H_2$, Vol. % | 69 | 73 | 81 |
| Recycle: | | | |
| $H_2$, kg/hr | 6,000 | 4,200 | 4,200 |
| $H_2$, Vol. % | 76 | 98 | 98 |
| Make-Up $H_2$: | | | |
| Hydrotreater Off Gas, kg/hr | 16,000 | 27,000 | 16,000 |
| Hydrogen plant, kg/hr | 2,000 | 0 | 2,000 |
| Hydrogen Feed Gas: | | | |
| $H_2$, kg/hr | 12,000 | 12,000 | 12,000 |
| $H_2$, Vol. % | 78 | 81 | 87 |
| Total, kg/hr | 39,000 | 35,000 | 27,000 |

What is claimed is:

1. A process for catalytically hydrocracking a hydrocarbonaceous feed comprising:

(a) cracking in a hydrocracking zone the hydrocarbonaceous feed in the presence of hydrogen and a hydrocracking catalyst under hydrocracking conditions comprising a temperature of at least about 250° C. and a pressure of at least about 45 atmospheres absolute wherein said hydrocracking zone has a hydrocracking vapor phase and a hydrocracking liquid phase wherein said hydrogen is provided by a hydrogen feed gas to produce a hydrocrackate, and wherein the hydrogen feed gas is provided in an amount sufficient to maintain a concentration of hydrogen in the hydrocracking vapor phase of at least about 65 volume percent;

(b) separating the hydrocrackate into at least one liquid phase and a separated vapor phase, said separated vapor phase being at a temperature less than about 70° C. and a pressure of at least about 0.5 times the pressure in the hydrocracking zone, the separated vapor phase has a concentration of hydrogen of at least 65 volume percent;

(c) bringing at least a portion of said separated vapor phase into contact with a feed side of a polymeric membrane selective to the permeation of hydrogen as compared to methane;

(d) maintaining the opposite side of the polymeric membrane at a pressure of at least about 20 atmospheres below the pressure at the feed side of the polymeric membrane to permeate hydrogen to the opposite side of the polymeric membrane and provide a hydrogen permeate having a concentration of hydrogen of at least about 90 volume percent;

(e) withdrawing non-permeate from the feed side of the polymeric membrane;

(f) removing the hydrogen permeate from said opposite side of the polymeric membrane;

(g) compressing the removed hydrogen permeate to a sufficient pressure for passage to the hydrocracking zone; and (h) then recycling the hydrogen permeate to the hydrocracking zone as a portion of the hydrogen feed gas.

* * * * *